US012490830B2

(12) United States Patent
Reese

(10) Patent No.: US 12,490,830 B2
(45) Date of Patent: Dec. 9, 2025

(54) REINFORCED RETRACTABLE ASSEMBLY FOR AN ENCLOSED STORAGE AREA

(71) Applicant: T Sportline, LLC, Downey, CA (US)

(72) Inventor: Brian Reese, Atlanta, GA (US)

(73) Assignee: T Sportline, LLC, Atlanta, GA (US)

( * ) Notice: Subject to any disclaimer, the term of this patent is extended or adjusted under 35 U.S.C. 154(b) by 97 days.

(21) Appl. No.: 18/631,219

(22) Filed: Apr. 10, 2024

(65) Prior Publication Data

US 2024/0335035 A1 Oct. 10, 2024

Related U.S. Application Data

(60) Provisional application No. 63/495,131, filed on Apr. 10, 2023.

(51) Int. Cl.
*A47B 88/40* (2017.01)
*A47B 88/919* (2017.01)

(52) U.S. Cl.
CPC ..... *A47B 88/40* (2017.01); *A47B 88/919* (2017.01)

(58) Field of Classification Search
CPC ..... A47B 88/43; A47B 88/044; A47B 88/423; A47B 88/0418; A47B 88/40; A47B 88/04; A47B 88/919; A47B 2088/0011; A47B 2210/0002
See application file for complete search history.

(56) References Cited

U.S. PATENT DOCUMENTS 2,496,997 A * 2/1950 Hallberg ..... A47B 88/43 312/334.7
2,620,252 A * 12/1952 Restivo ..... A47B 88/43 312/317.1
3,497,279 A * 2/1970 Chovanec ..... A47B 47/05 312/257.1
4,440,455 A * 4/1984 Lanting ..... A47B 88/43 384/22
4,555,147 A * 11/1985 Jackson ..... A47B 88/43 384/19
4,712,844 A * 12/1987 Fry ..... F16B 12/18 312/257.1
4,848,608 A * 7/1989 Anderson ..... A47B 57/32 211/126.15
5,421,647 A * 6/1995 Simons ..... A47B 88/43 312/265.4

(Continued)

FOREIGN PATENT DOCUMENTS

CN 111789426 A * 10/2020 ..... A47B 88/40
DE 102011050444 A1 * 11/2012 ..... A47B 47/025

(Continued)

*Primary Examiner* — Andrew Roersma
(74) *Attorney, Agent, or Firm* — Sisson & Banyas, Attorneys at Law, LLC; Jeffrey J. Banyas

(57) ABSTRACT

A retractable assembly for an enclosed storage area comprises a first glider, a second glider, at least one brace member, and a planar member. Each of the first glider and the second glide member has a glide track and a glide member configured to slideably engage with the glide track. Each of the glide tracks is independently configured to connect to a wall of the enclosed storage area. The at least one brace member is configured to connect between one wall of the enclosed storage area and a terminal end of one of the glide tracks. The planar member is connected between the two glide members.

10 Claims, 9 Drawing Sheets

(56) References Cited

U.S. PATENT DOCUMENTS

| | | | | |
|---|---|---|---|---|
| 5,570,941 | A * | 11/1996 | Rock | A47B 88/43 312/334.6 |
| 9,756,941 | B1 * | 9/2017 | Rowland | A47B 88/427 |
| 10,299,586 | B1 * | 5/2019 | Powwarynn | A47B 88/423 |
| 10,499,736 | B2 * | 12/2019 | Chen | A47B 88/407 |
| 2007/0252494 | A1 * | 11/2007 | Freedenberg | A47B 88/40 312/334.4 |
| 2015/0002008 | A1 * | 1/2015 | Domenig | B21D 35/001 312/334.8 |
| 2017/0055703 | A1 * | 3/2017 | Corless | A47B 88/42 |
| 2018/0317648 | A1 * | 11/2018 | Erickson | A47B 88/43 |
| 2019/0174919 | A1 * | 6/2019 | Greenwood | A47B 88/407 |
| 2020/0323341 | A1 * | 10/2020 | Briosi | A47B 47/0083 |
| 2020/0373743 | A1 * | 11/2020 | Chambers | H01R 13/5213 |
| 2021/0079726 | A1 * | 3/2021 | Chiao | A47B 55/02 |
| 2021/0386200 | A1 * | 12/2021 | Bonin | A47B 88/497 |
| 2023/0356662 | A1 * | 11/2023 | Desai | B60R 7/02 |
| 2024/0166118 | A1 * | 5/2024 | Parker | B60P 3/34 |

FOREIGN PATENT DOCUMENTS

| | | | | |
|---|---|---|---|---|
| EP | 1479315 | A1 * | 11/2004 | A47B 81/002 |
| EP | 2937017 | A1 * | 10/2015 | A47B 88/43 |
| KR | 1020100052699 | A * | 5/2010 | |
| WO | WO-2020161690 | A2 * | 8/2020 | A47B 77/10 |

* cited by examiner

REINFORCED RETRACTABLE ASSEMBLY FOR AN ENCLOSED STORAGE AREA

CROSS REFERENCES AND PRIORITIES

This application claims priority from U.S. Provisional Application No. 63/495,131 filed on 10 Apr. 2023, the teachings of which are incorporated by reference herein in their entirety.

BACKGROUND

Slide-out shelves, drawers, and other storage apparatuses are found in a wide array of applications including kitchen cupboards, bathroom vanities, refrigerators, server cabinets, toolboxes, and vehicle storage compartments. The typical slide-out apparatus includes a pair of opposing tracks into which slideable members are disposed. The slideable members are connected to the shelf, drawer, or other storage apparatus. The tracks are then connected to the interior of the cupboard, vanity, refrigerator, cabinet, toolbox, storage compartment, etc. in such as way as to allow the slideable members to slideably engage with the tracks so that a user can extend the apparatus out of the storage area and retract the apparatus back into the storage area by hand.

In practice, slide-out shelves, drawers, and other storage apparatuses often suffer failures—particularly when the shelf, drawer, or apparatus is carrying a heavy load. The heavy load can cause the larger storage area (cupboard, vanity, refrigerator, cabinet, box, etc.) to become unbalanced and tip when the apparatus is extended out of the storage area if the larger storage area is not properly secured or weighted to balance the weight loaded onto the apparatus. Even when the larger storage area is properly secured or weighted, the heavy load on the apparatus can often lead to breakage of the connection between the track(s) and the interior of the larger storage space.

Many solutions have been proposed for this problem. One such solution is to provide an extendable brace at the user facing end of the shelf, drawer, or storage apparatus. For example, U.S. Pat. No. 4,372,632 describes a horizontally movable outrigger-type support brace, is mounted to a cabinet having a drawer. When the brace is in a stored position within the cabinet or in any position intermediate the stored position and a fully extended position, a peg which is on the interlock bar and slideably rides over the brace keeps the interlock bar in a raised position whereby the drawer is locked in a closed position within the cabinet. When the brace is in the fully extended position to support the cabinet from tipping, the peg is disposed in a hole formed in the brace so that the brace is locked in the extended position and the interlock bar is in a lowered position whereby the drawer is unlocked.

The common solution of an extendable brace at the user facing end of the shelf, drawer, or other storage apparatus often proves insufficient. These solutions have to be deployed manually upon extending the drawer. In practice, the extendable brace is often either left undeployed, or the user is unable to deploy the extendable brace in time to prevent tipping and/or breakage of the connection between the track(s) and the interior of the larger storage space. In addition, the user must take the extra step of retracting the extendable brace when moving the shelf, drawer, or other storage apparatus back into the larger storage area.

The need exists, therefore, for an improved apparatus and system to reduce or prevent tipping and/or breakage of the connection between a track of a slideable shelf, drawer, or other storage apparatus and the wall to which it is connected.

SUMMARY

Described herein is a retractable assembly for an enclosed storage area. The retractable assembly comprises at least a first glider, a second glider, at least one brace member, and a planar member. The first glider has a first glide track and a first glide member configured to slideably engage with the first glide track. The second glider has a second glide track and a second glide member configured to slideably engage with the second glide track. The at least one brace member is configured to connect between one wall of the enclosed storage area and a first glide track terminal end or a second glide track terminal end. The planar member is connected between the first glide member and the second glide member. The first glide track and the second glide track are each independently configured to connect to a wall of the enclosed storage area.

In some embodiments, the first glide track and the second glide track may be configured to connect to the same wall of the enclosed storage area. In other embodiments, the first glide track may be configured to connect to a first wall of the enclosed storage area while the second glide track may be configured to connect to a second wall of the enclosed storage area with the second wall being opposite the first wall.

In certain embodiments, the at least one brace member may be a longitudinal brace member. In some such embodiments, the at least one brace member may comprise a first brace member and a second brace member with the first brace member configured to connect between the one wall of the enclosed storage area and the first glide track terminal end, and the second brace member connected between a first brace member terminal end and the second glide track terminal end. In certain such embodiments, the retractable assembly may further comprise a third brace member which may be configured to connect between the first brace member and a third wall of the enclosed storage area which is perpendicular with the one wall of the enclosed storage area. In some other embodiments, the at least one brace member may be a planar brace member.

In some embodiments, the planar member may comprise a first end edge, a second end edge opposite the first end edge, a first side edge, and a second side edge opposite the first side edge. In such embodiments, the retractable assembly may further comprise a first planar member wall, a second planar member wall, a third planar member wall, and a fourth planar member wall. The first planar member wall may be connected to and extend upwardly from the first end edge. The second planar member wall may be connected to and extend upwardly from the second end edge. The third planar member wall may be connected to and extend upwardly from the first side edge. The fourth planar member wall may be connected to and extend upwardly from the second side edge.

In certain embodiments, the enclosed storage area may be a cargo tunnel of an electric vehicle.

In some embodiments, the first glider and the second glider may each independently be selected from the group consisting of a ball bearing drawer slide, a bottom mount drawer slide, a side mount drawer slide, a self-closing drawer slide, a soft close drawer slide, a full extension drawer slide, a telescoping drawer slide, a roller drawer slide, a three-piece drawer slide, and combinations thereof.

DETAILED DESCRIPTION

Disclosed herein is a retractable assembly for an enclosed storage area. The retractable assembly is described below with reference to the Figures. As described herein and in the claims, the following numbers refer to the following structures as noted in the Figures.

5 refers to an electric vehicle.
10 refers to a retractable assembly.
50 refers to an enclosed storage area.
51 refers to a first wall.
52 refers to a second wall.
53 refers to a third wall.
70 refers to a cargo tunnel.
100 refers to a first glider.
110 refers to a first glide track.
111 refers to a first glide track terminal end.
120 refers to a first glide member.
200 refers to a second glider.
210 refers to a second glide track.
211 refers to a second glide track terminal end.
220 refers to a second glide member.
250 refers to a bottom mount draw slide.
300 refers to a brace member.
310 refers to a first brace member.
320 refers to a second brace member.
330 refers to a third brace member.
340 refers to a planar brace member.
400 refers to a planar member.
410 refers to a first end edge.
415 refers to a first planar member wall.
420 refers to a second end edge.
425 refers to a second planar member wall.
430 refers to a first side edge.
435 refers to a third planar member wall.
440 refers to a second side edge.
445 refers to a fourth planar member wall.

Figure 1:
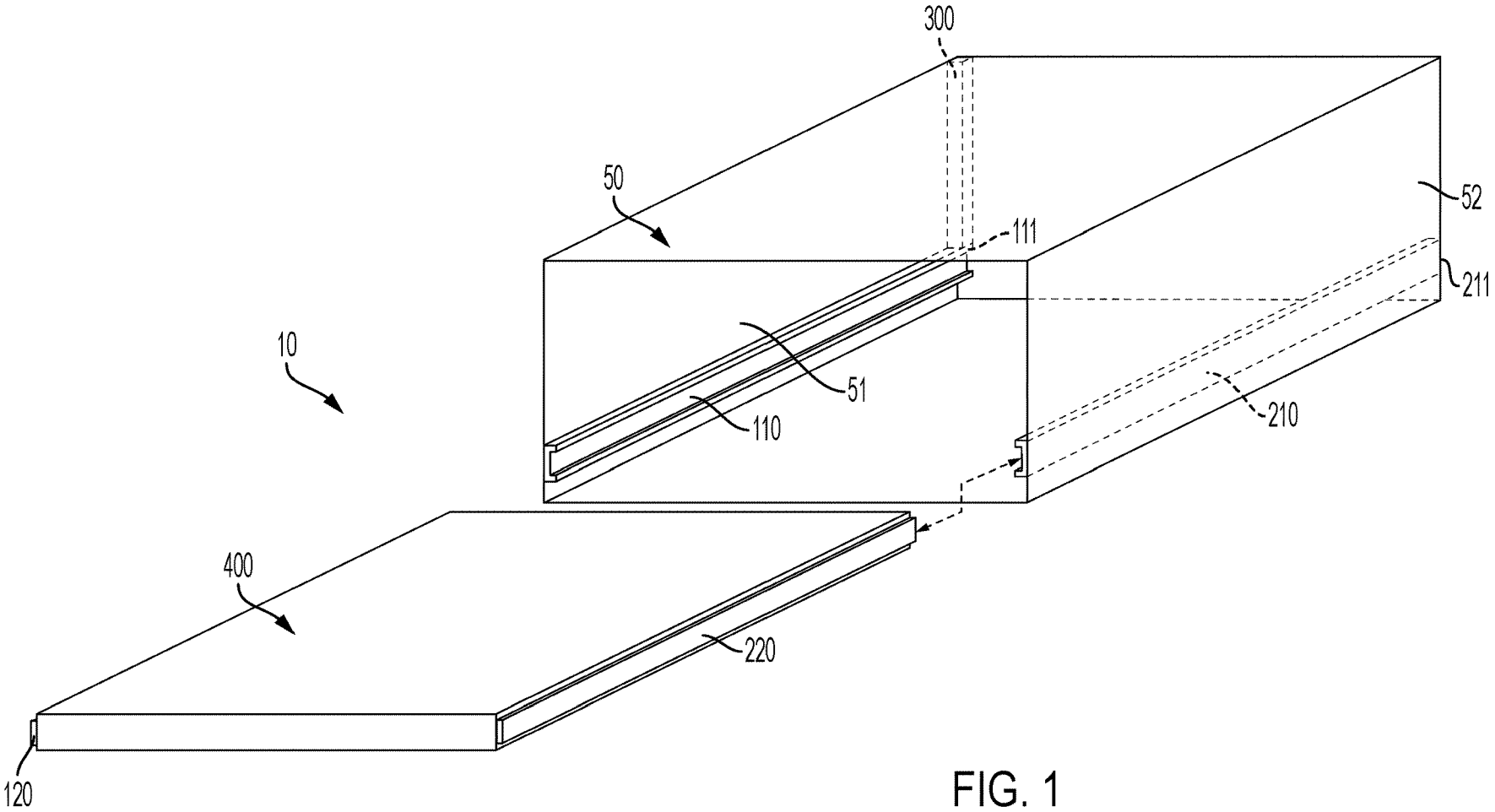
FIG. 1 is a perspective view of a retractable assembly for an enclosed storage area.
Figure 2:
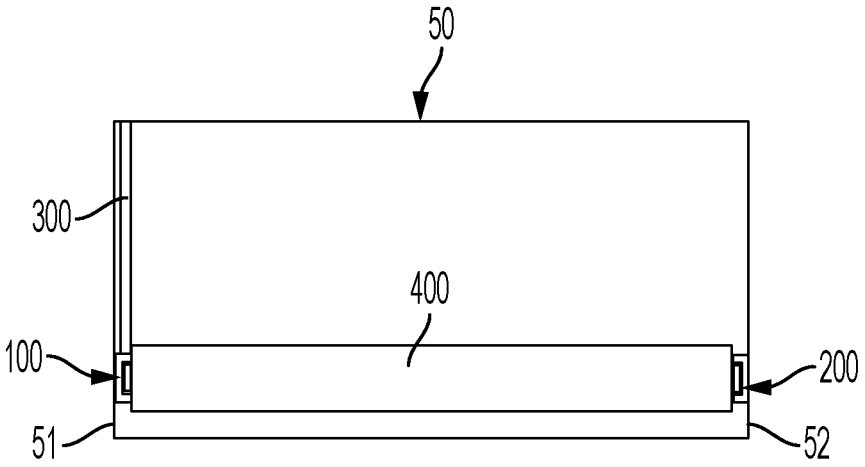
FIG. 2 is a front view of a retractable assembly for an enclosed storage area.

FIG. 1 shows a retractable assembly (10) for an enclosed storage area (50). The retractable assembly may comprise at least a first glider (100 as shown in FIG. 2), a second glider (200 as shown in FIG. 2), at least one brace member (300), and a planar member (400).

The enclosed storage area (50) may be of a cube or cuboid shape as shown in FIG. 1. Such an enclosed area will have a plurality of walls including at least a bottom wall, a top wall opposing the bottom wall, a first side wall between the bottom wall and the top wall, and a second side wall opposing the first side wall. The plurality of walls may also include a rear wall spanning between the top wall, bottom wall, first side wall, and second side wall. In some embodiments, a hinged door or other covering may oppose the rear wall.

As shown in FIG. 1, the first glider (100) has a first glide track (110) and a first glide member (120) with the first glide member configured to slideably engage with the first glide track. The first glide track is configured to attach to a wall—typically at least one of the top wall, the bottom wall, the first side wall, and/or the second side wall—of the enclosed storage area (50) via a fastener such as a screw, bolt, rivet, clamp, or the like. The first glide member is configured to attach to an edge of the planar member (400) via a fastener such as a screw, bolt, rivet, clamp, or the like.

Similarly, FIG. 1 shows the second glider (200) having a second glide track (210) and a second glide member (220) with the second glide member configured to slideably engage with the second glide track. The second glide track is configured to attach to a wall—typically at least one of the top wall, the bottom wall, the first side wall, and/or the second side wall—of the enclosed storage area (50) via a fastener such as a screw, bolt, rivet, clamp, or the like. The second glide member is configured to attach to an edge of the planar member (400) via a fastener such as a screw, bolt, rivet, clamp, or the like.

Any number of designs and configurations of gliders known in the art—and those still to be developed—may be used for the first glider (100) and/or the second glider (200). The simplest design comprises a glide track in the form of a longitudinal channel and a glide member which is a longitudinal rod sized and shaped to extend into and out of the longitudinal channel. Other gliders include ball bearing drawer slides, bottom mount drawer slides (such as (250) shown in FIG. 9), side mount drawer slides, self-closing drawer slides, soft close drawer slides, full extension drawer slides, telescoping drawer slides, roller drawer slides, three-piece drawer slides, and combinations thereof.

The at least one brace member (300) may be configured to connect between one wall of the enclosed storage area (50) and either a first glide track terminal end (111)—as shown in FIG. 1—or a second glide track terminal end (211). The connection between the brace member and the terminal end of the glide track may take many forms. In some embodiments, the brace member may be integral to the glide track, such as by manufacturing the brace member and the glide track of a single piece of material or by welding the brace member to the terminal end of the glide track. In other embodiments, the brace member may be removably connected to the glide track by a fastener such as a screw, a bolt, a rivet, a clamp, or the like. The connection between the brace member and the wall of the enclosed storage area will preferably come via a fastener such as a screw, a bolt, a rivet, a clamp, or the like.

The planar member (400) may be connected between the first glide member (120) and the second glide member (220) as shown in FIG. 1. The first glide track (110) and the second glide track (210) will be oriented and spaced within the enclosed storage area (50) in such a way that allows the first glide member (120)—which is connected to an edge of the planar member—to slideably engage the first glide track while the second glide member (220)—which is connected to an opposing edge of the planar member—slideably engages the second glide track. In doing so, the planar member may be extended out of and retracted into the enclosed storage area by the hand of a user.

In many embodiments, the first glider (100) and the second glider (200) will be configured to connect to opposing walls of the enclosed storage area (50). One such embodiment is shown in FIG. 1 through FIG. 3 with the first glide track (110) configured to connect to a first wall (51)—which in this case is the first side wall—and the second glide track (210) configured to connect to a second wall (52)—which in this case is the second side wall.

In some other embodiments, the first glider (100) and the second glider (200) will be configured to connect to the same wall of the enclosed storage area. One such embodiment is shown in FIG. 4—having the first glide track (110) and the second glide track (210) connected to the same wall—which in this case is the bottom wall.

The at least one brace member (300) may take many forms. One common form is a longitudinal brace member such as shown in FIG. 1 and FIG. 2. The shape of the longitudinal brace member is not considered important as the longitudinal brace member may be in many different forms such as a rod. When the longitudinal brace member is a rod, the rod may have a radial cross-sectional profile which is circular, triangular, quadrilateral, hexagonal, or the like. Alternatively, the longitudinal brace member may be a flat longitudinal member such as a strip of material. The longitudinal brace member may also have a complex form such as a longitudinal channel or an "L" shaped longitudinal brace member.

Figure 3:
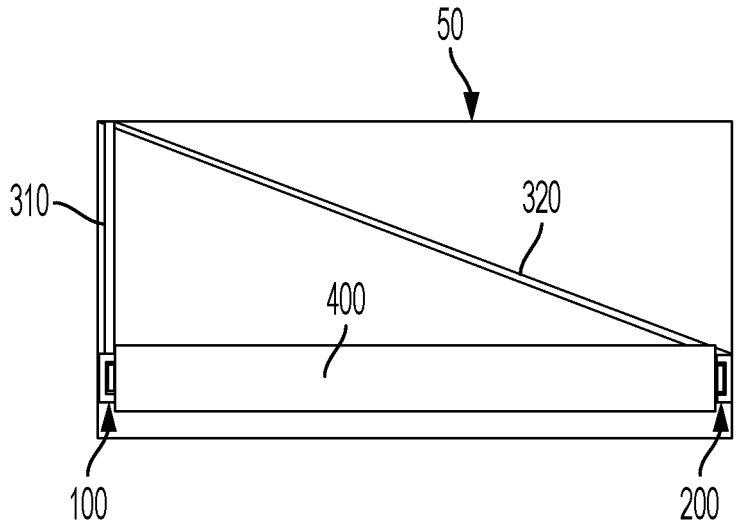
FIG. 3 is a front view of an alternative retractable assembly for an enclosed storage area.

FIG. 3 shows an embodiment which includes two brace members of a longitudinal brace member type—referred to herein as a first brace member (310) and a second brace member (320). As shown in FIG. 3, the first brace member may be configured to connect between the one wall of the enclosed area—which in this case is the top wall—and the first glide track terminal end. The second brace member may then be connected between the first brace member terminal end and the second glide track terminal end (211).

Figure 4:
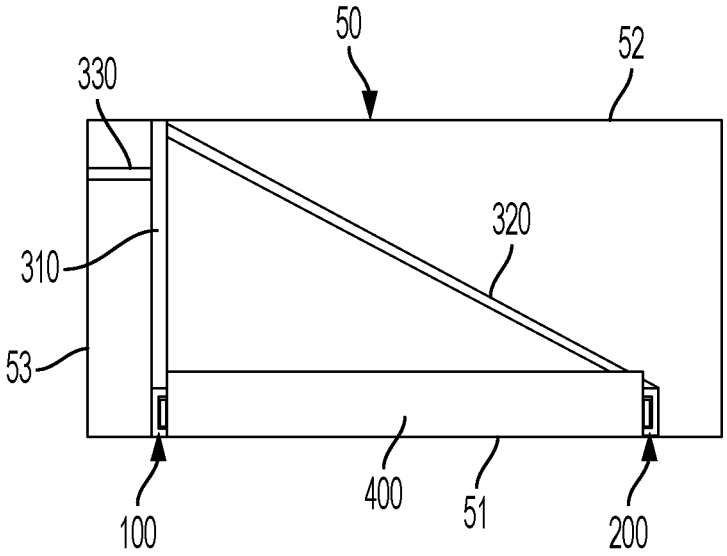
FIG. 4 is a front view of an alternative retractable assembly for an enclosed storage area.

In FIG. 4, a third brace member (330) has been added. The third brace member is configured to connect between the first brace member and a third wall (53) of the enclosed storage area (50). The third wall is perpendicular with the one wall of the enclosed storage area to which the first glide track is connected. In the embodiment shown in FIG. 4, the one wall of the enclosed storage area to which the first glide track is connected is the bottom wall while the third wall is the first side wall.

Figure 5:
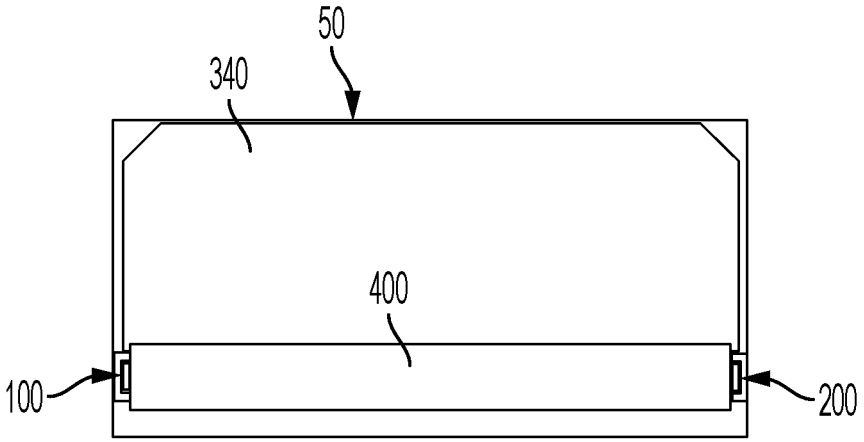
FIG. 5 is a front view of an alternative retractable assembly for an enclosed storage area.

FIG. 5 shows an alternative embodiment in which the at least one brace member is a planar brace member (340). The planar brace member takes the form of a flat sheet of material. When utilized, the planar brace member may be configured to connect between the first glide track terminal end (111), the second glide track terminal end (211), and at least one wall of the enclosed storage area (50) as shown in FIG. 5. While the size and shape of the planar brace member is not considered important, the planar base member will typically be sized and shaped to fit within the confines of the enclosed storage area and span at least the distance between the first glide track (110) and the second glide track (210).

Figure 6:
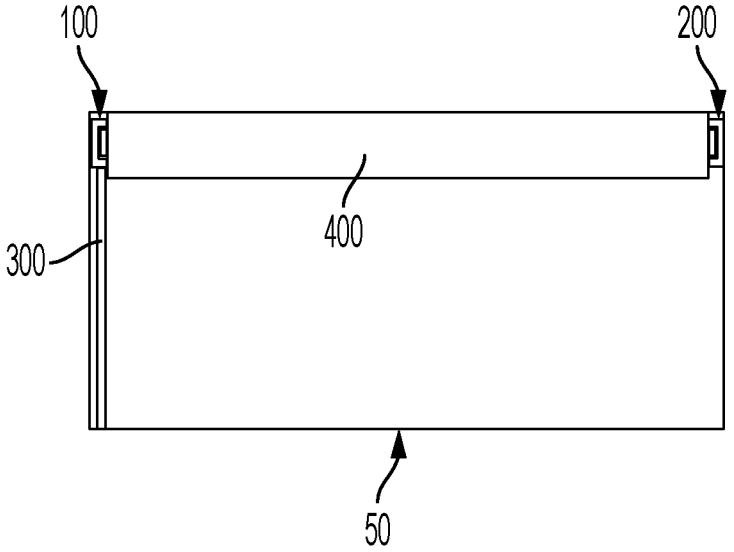
FIG. 6 is a front view of an alternative retractable assembly for an enclosed storage area.
Figure 7:
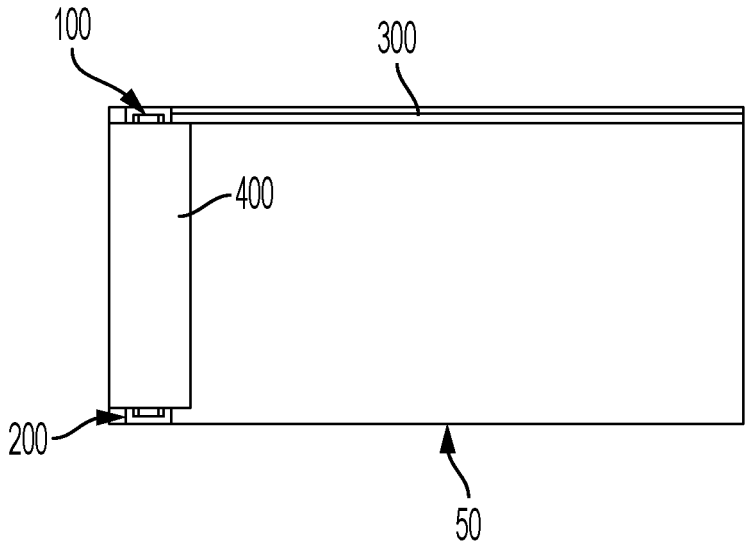
FIG. 7 is a front view of an alternative retractable assembly for an enclosed storage area.

While FIG. 1 through FIG. 5 show the planar member (400) at or near the bottom wall of the enclosed storage area (50), the invention is not limited to such embodiments. For example, FIG. 6 shows the planar member configured to connect at or near the top wall of the enclosed storage area. FIG. 7 shows the planar member configured to connect at or near a side wall—which in the case of FIG. 7 is the first side wall—of the enclosed storage area. Such embodiments may utilize any type and/or combination of features disclosed herein for the gliders, brace member(s), and planar member.

Figure 8:
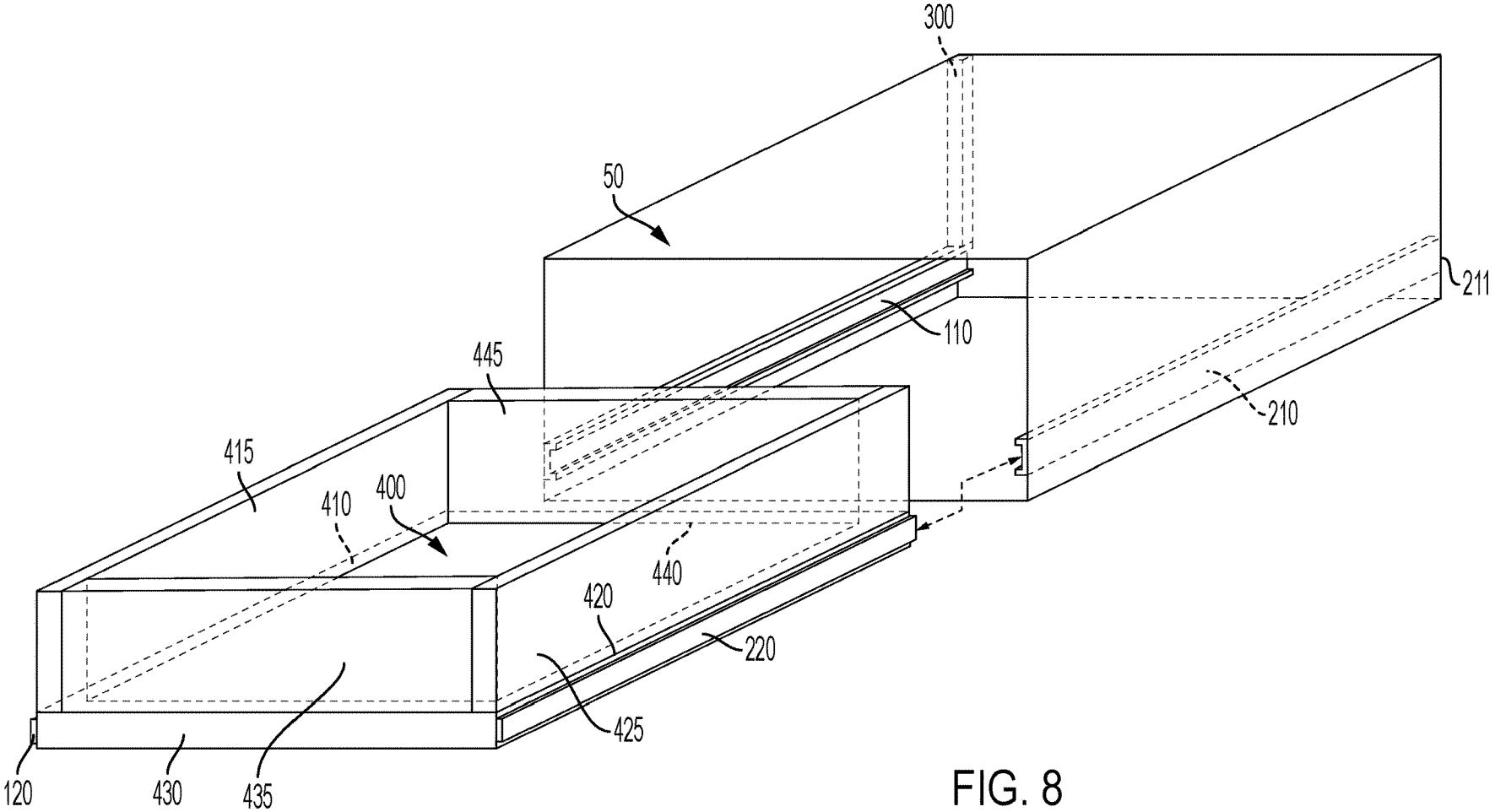
FIG. 8 is a perspective view of an alternative retractable assembly for an enclosed storage area.

FIG. 8 shows a perspective view of an embodiment of the retractable assembly (10) in which the planar member (400) includes four walls which—in combination with the planar member—form a drawer. As shown in FIG. 8, the planar member has a first end edge (410) with a first planar member wall (415) connected to and extending upwardly from the first end edge. The planar member also has a second end edge (420) with a second planar member wall (425) connected to and extending upwardly from the second end edge. The planar member further has a first side edge (430) with a third planar member wall (435) connected to and extending upwardly from the first side edge. Finally, the planar member has a second side edge (440) with a fourth planar member wall (445) connected to and extending upwardly from the second side edge.

Figure 9:
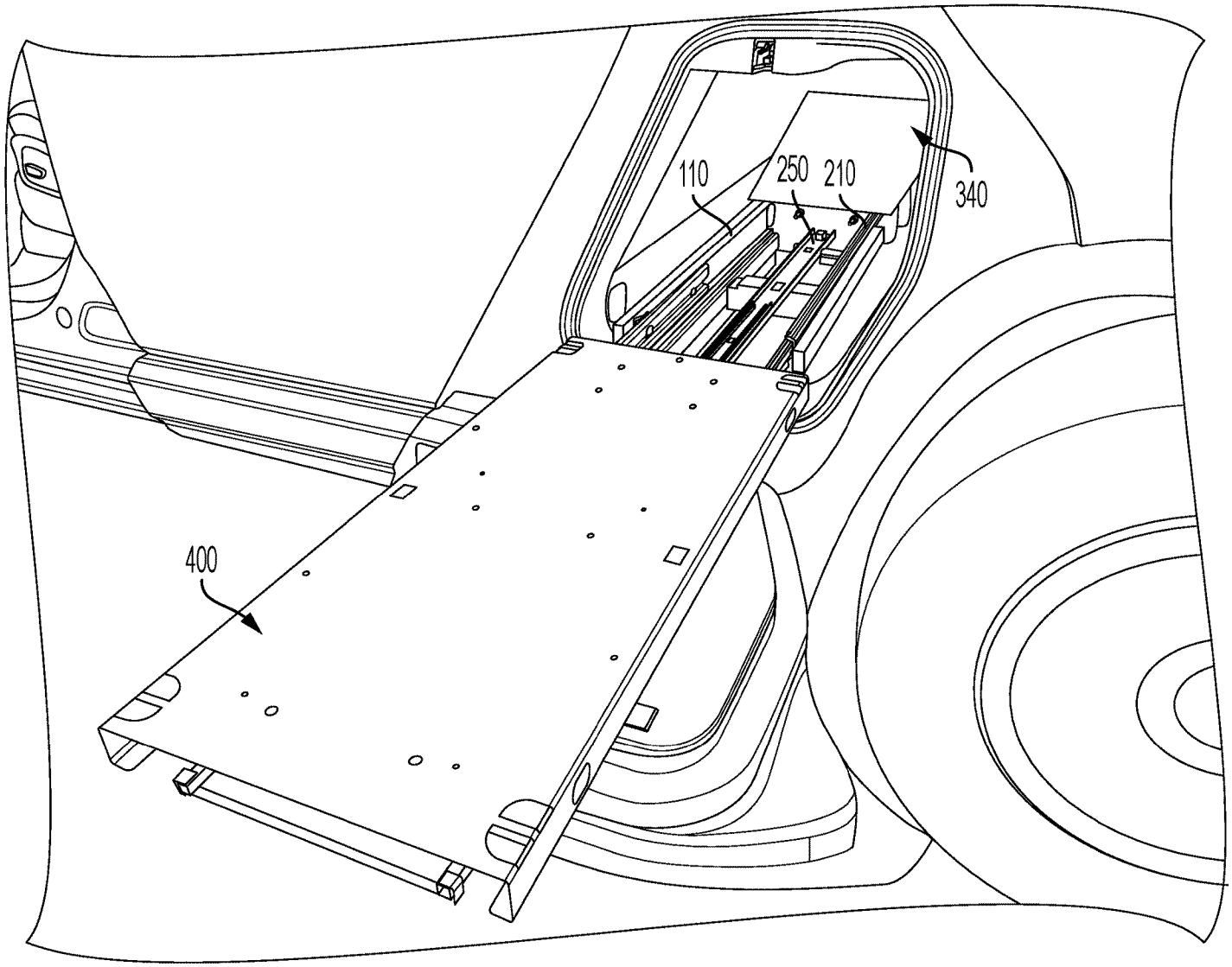
FIG. 9 is a side view of an electric vehicle having a cargo tunnel.

The enclosed storage area (50) may take many forms. One such form is shown in FIG. 9 which is a cargo tunnel (70) of an electric vehicle (5). In this case, the electric vehicle is a Rivian® model truck available from Rivian Automotive, Inc. of Irvine, California, U.S.A. Other enclosed storage areas might include a kitchen cupboard, a bathroom vanity, a refrigerator, a server cabinet, a tool box, or the like.

The brace member(s) disclosed herein help to reduce or prevent breaking of the connection between the glide track(s) and the wall of the enclosed storage area when the planar member is extended out of the enclosed storage area. In this position, the weight of the planar member—particularly in instances when the planar member is a drawer filled with heavy items—causes a rotational force to be applied extending through the glide members and through to the glide track terminal ends. This rotational force can cause one or more of the fasteners which connects the track(s) to the wall of the enclosed storage area to break or otherwise separate from the wall. By bracing one or both of the glide track terminal ends to an opposing wall of the enclosed storage area, a portion of the rotational force is distributed through the brace which abuts against the opposing wall, thereby reducing or preventing the likelihood that the fasteners which connect the track(s) to the wall of the enclosed storage area might break or otherwise separate from the wall.

While the invention has been described as having exemplary designs, the present invention may be further modified within the spirit and scope of this disclosure. This application is therefore intended to cover any variations, uses, or adaptations of the invention using its general principles.

What is claimed is:

1. A retractable assembly (10) for an enclosed storage area (50), said retractable assembly comprising:

a first glider (100) having a first glide track (110) and a first glide member (120) configured to slideably engage with the first glide track;

a second glider (200) having a second glide track (210) and a second glide member (220) configured to slideably engage with the second glide track;

a first brace member (310) configured to connect between one wall of the enclosed storage area and a first glide track terminal end (111), and a second brace member (320) connected between a first brace member terminal end and a second glide track terminal end (211), and a third brace member (330) configured to connect between the first brace member and a third wall (53) of the enclosed storage area which is perpendicular with the one wall of the enclosed storage area, and a planar member (400) connected between the first glide member and the second glide member; and wherein the first glide track and the second glide track are each independently configured to connect to a wall of the enclosed storage area, and wherein the first brace member and the second brace member are each longitudinal brace members.

2. The retractable assembly of claim 1, wherein the planar member comprises a first end edge (410), a second end edge (420) opposite the first end edge, a first side edge (430), and a second side edge (440) opposite the first side edge; and wherein the retractable assembly further comprises:

a first planar member wall (415) connected to and extending upwardly from the first end edge;

a second planar member wall (425) connected to and extending upwardly from the second end edge;

a third planar member wall (435) connected to and extending upwardly from the first side edge; and a fourth planar member wall (445) connected to and extending upwardly from the second side edge.

3. The retractable assembly of claim 1, wherein the enclosed storage area is a cargo tunnel (70) of an electric vehicle (5).

4. The retractable assembly of claim 1, wherein the first glider and the second glider are each independently selected from the group consisting of a ball bearing drawer slide, a bottom mount drawer slide, a side mount drawer slide, a self-closing drawer slide, a soft close drawer slide, a full extension drawer slide, a telescoping drawer slide, a roller drawer slide, a three-piece drawer slide, and combinations thereof.

5. The retractable assembly of claim 1, wherein the first glide track and the second glide track are configured to connect to the same wall of the enclosed storage area.

6. The retractable assembly of claim 1, wherein the first glide track is configured to connect to a first wall (51) of the enclosed storage area, and the second glide track is configured to connect to a second wall (52) of the enclosed storage area with the second wall being opposite the first wall.

7. The retractable assembly of claim 5, wherein the first glider and the second glider are each independently selected from the group consisting of a ball bearing drawer slide, a bottom mount drawer slide, a side mount drawer slide, a self-closing drawer slide, a soft close drawer slide, a full extension drawer slide, a telescoping drawer slide, a roller drawer slide, a three-piece drawer slide, and combinations thereof.

8. The retractable assembly of claim 6, wherein the first glider and the second glider are each independently selected from the group consisting of a ball bearing drawer slide, a bottom mount drawer slide, a side mount drawer slide, a self-closing drawer slide, a soft close drawer slide, a full extension drawer slide, a telescoping drawer slide, a roller drawer slide, a three-piece drawer slide, and combinations thereof.

9. The retractable assembly of claim 5, wherein the enclosed storage area is a cargo tunnel (70) of an electric vehicle (5).

10. The retractable assembly of claim 6, wherein the enclosed storage area is a cargo tunnel (70) of an electric vehicle (5).

* * * * *